United States Patent [19]

Signoretto

[11] Patent Number: 4,932,189

[45] Date of Patent: Jun. 12, 1990

[54] APPARATUS FOR AUTOMATICALLY INSERTING PACKS OF PHOTOGRAPHIC NEGATIVES AND PRINTS INTO ENVELOPES

[75] Inventor: Roberto Signoretto, Venezia, Italy

[73] Assignee: Photo Engineering International S.r.l., Olmo Di Martellago, Italy

[21] Appl. No.: 266,062

[22] Filed: Nov. 2, 1988

[30] Foreign Application Priority Data

Nov. 6, 1987 [IT] Italy ..... 84172 A/87

[51] Int. Cl.[5] ..... B65B 5/06; B65B 5/08; B65B 43/34

[52] U.S. Cl. ..... 53/64; 53/569

[58] Field of Search ..... 53/569, 570, 571, 64, 53/238, 266 A

[56] References Cited

U.S. PATENT DOCUMENTS

| | | | |
|---|---|---|---|
| 2,973,610 | 3/1961 | Randall | 53/571 |
| 3,423,900 | 1/1969 | Orsinger | 53/571 X |
| 3,936,993 | 2/1976 | Dorer | 53/569 X |
| 4,539,794 | 9/1985 | Azzaroni | 53/238 X |
| 4,798,040 | 1/1989 | Haas et al. | 53/569 X |

*Primary Examiner*—Horace M. Culver

*Attorney, Agent, or Firm*—Charles Fallow; Martin Hoffman

[57] ABSTRACT

A device for automatically inserting packs of photographic negatives and prints into respective pockets of a series of envelopes includes separate guides for supporting and guiding the negatives and prints toward the envelopes, which are supported by a conveyor having intermittent forward and retrograde movement. The device includes a pair of blades which engage the pockets when the envelopes are moved rearward, and then are raised to open the pocket, to permit the automatic insertion.

7 Claims, 2 Drawing Sheets

Figure 1:
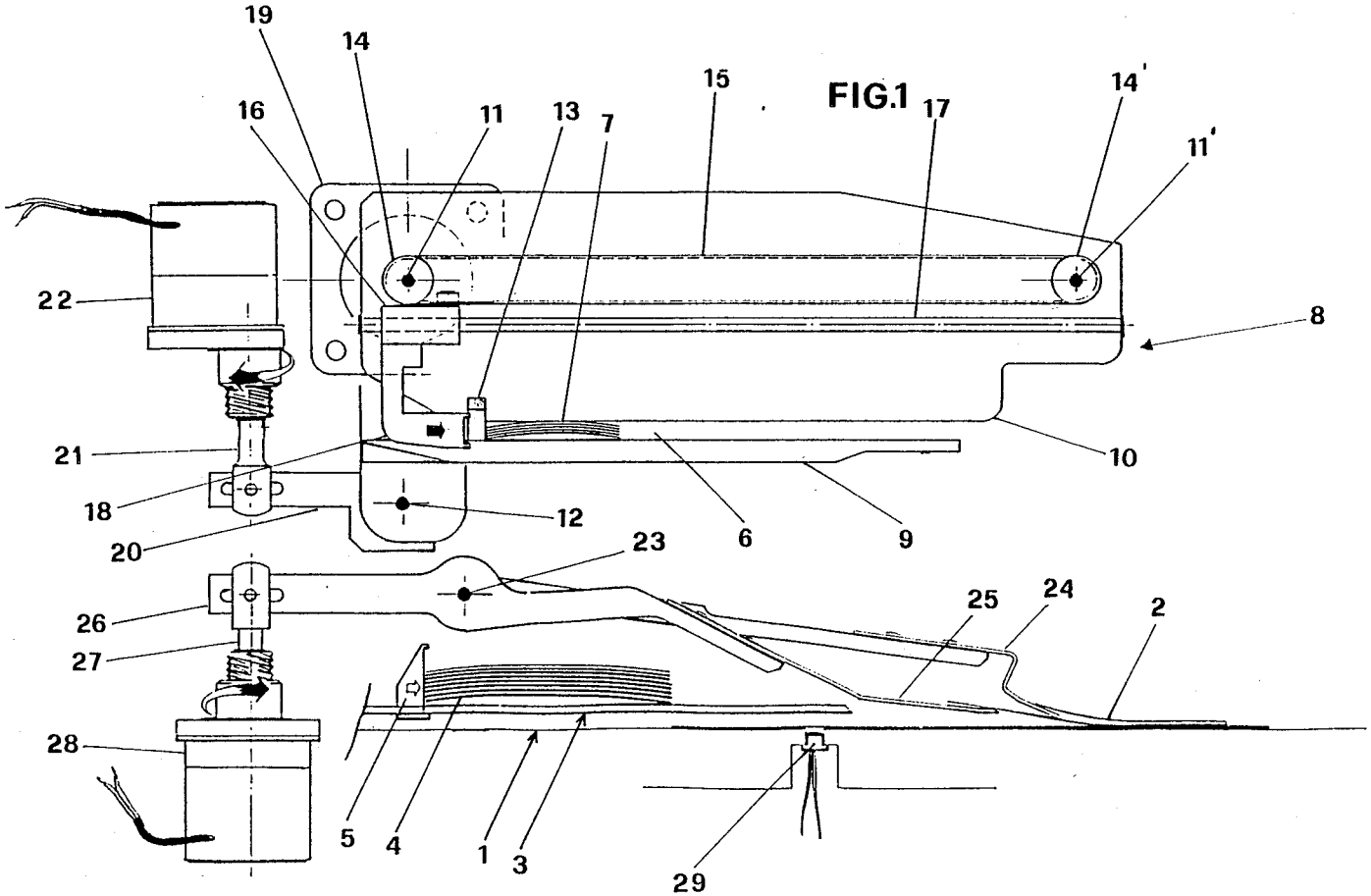

APPARATUS FOR AUTOMATICALLY INSERTING PACKS OF PHOTOGRAPHIC NEGATIVES AND PRINTS INTO ENVELOPES

This invention relates to a device for automatically inserting packs of photographic negatives and prints into envelopes.

In photographic laboratories in which negatives are handled, developed and printed, it is known to insert the pack of negatives and the pack of the corresponding prints into separate pockets of an envelope at the end of the processing cycle. This operation, generally known as wallet-filling, is currently done in different ways according to the type of envelope used.

In the case of automatic wallet-filling, a type of envelope is known in the form of a continuous module, in which pockets are provided with a lateral opening, i.e. parallel to the feed direction of the continuous module, so that the pocket opening is presented to facing members for inserting the negatives and prints.

And, it is also known that an envelope may be provided with a pocket with a lateral opening for insertion of the negative pack, and a pocket with a frontal opening for insertion of the print pack.

These are special envelopes in which the two orthogonal negative insertion and print insertion movements require two differently driven insertion members, and the print pocket is opened by pneumatic systems requiring an air distribution system.

Automatic wallet-filling devices are also known which use conventional envelopes, also known as standard envelopes, with two front pockets into which the negatives and prints are inserted. These devices open the two pockets by means of pneumatic systems in which sucker members have to be exactly positioned on the flaps of the two pockets to be lifted, and for this reason besides requiring a pneumatic system they also demand a rigorously defined envelope format in contrast to current requirements which include personalization for the different photographic shops.

An object of the invention is to overcome the limits of the prior art by providing a device which allows automatic insertion of negatives and prints into standard envelopes.

A further object of the invention is to provide a device which does not require pneumatic systems for its operation.

A further object of the invention is to provide a device which is of simple construction and of safe and reliable operation.

These and further objects which will be apparent from the description given hereinafter are attained according to the invention by a device for automatically inserting pack of photographic negatives and prints into envelopes, characterised by comprising in combination:

a member for transversely moving the envelopes in both directions along their own guide, a transferer for transversely transferring each pack of negatives along their own guide towards said envelopes, a transferer for transversely transferring each pack of prints along their own guide towards said envelopes, a pair of members for the independent mechanical engagement of the edges of the two pockets of the envelope, and mobile between a position in which they adhere to said envelope guide and a position raised therefrom to present said open pockets facing said guides for the negative pack and for the print pack.

a control system which halts the feed of said envelope along its guide after the edges of its two pockets have passed beyond their respective engagement members and causes it to reverse to effect said engagement before it raises them in order to open said pockets.

Figure 2:
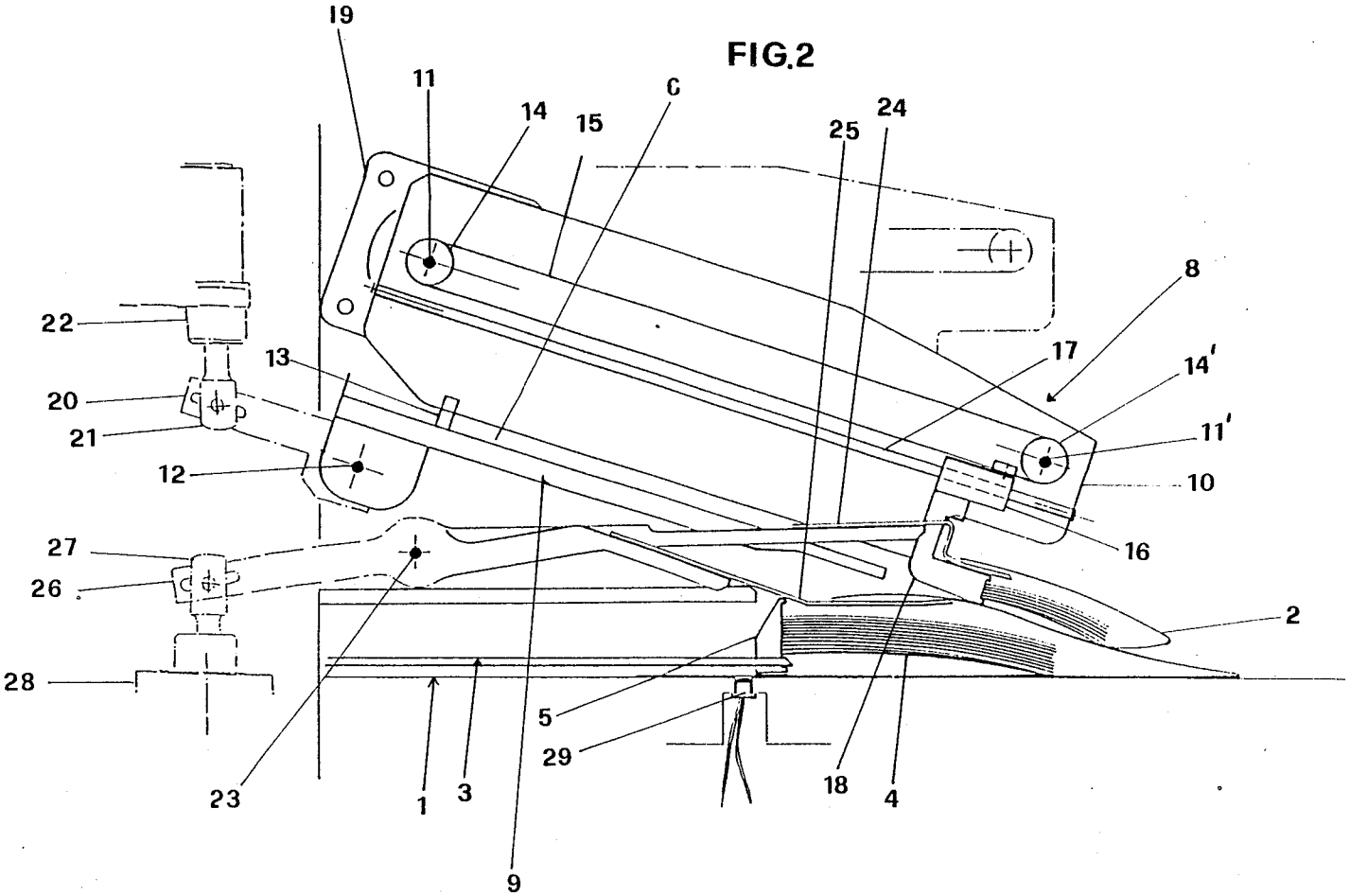

The present invention is described in detail hereinafter with reference to the accompanying drawings in which:

FIG. 1 is a partly sectional side view of the device according to the invention during the stage which precedes the opening of the two envelope pockets; and FIG. 2 shows it during the insertion of the packs of negatives and prints into their separate pockets of the envelope.

As can be seen from the figures, the device according to the invention is positioned in the zone of convergence of three superposed guides, namely a lower guide 1 for the envelopes 2, which are fed by conventional belt systems, not shown on the drawings for simplicity; an intermediate guide 3, parallel to the guide 1, for guiding the pack of prints 4 which are fed transversely, i.e. parallel to their minor side, by pusher member 5 which does not form part of the present invention; and an upper guide 6, disposed orthogonal to the preceding, for guiding the pack of negative strips 7.

The guide 6 leads to a tray structure indicated overall by 8 and comprising in reality a transversely slotted lower plate 9 (that is orthogonally to the axis of the negatives 7), as an extension of the base of the guide 6, and an overlying, tray 10 with the underside of its base facing the plate 9 and comprising slots identical to those in this latter, and with its interior housing the pusher members for the packs of negatives 7, as described hereinafter.

The tray 10 is hinged to the plate 9 about a horizontal shaft 11 so that it can assume two different end positions, one being the working position in which the base of said tray 10 is parallel to the plate 9 and defines therewith an interspace designed to receive the pack of negatives 7, and the other being an inspection position for said interspace.

In addition the tray structure 8, i.e. that formed by the plate 9 and actual tray 10, is fixed to a further shaft 12 parallel to the shaft 11 and fixed to the overall frame of the device according to the invention.

A longitudinal strip 13 of thickness equal to the minimum height of the interspace formed with the tray 10 is applied to the plate 9, and is in the form of segments to define transverse slots which extend the slots of the plate 9 and of the base of the tray 10.

Two pulleys 14 are applied to the shaft 11 on which the tray 10 is hinged to the plate 9, and drive two belts 15 which pass about two further pulley 14' which are mounted on a shaft 11' parallel to the shaft 11. A bar 16 is fixed to the two belts 15 and is mobile along two guide rods 17 disposed orthogonal to the shafts 11 and 11', to the bar 16 there being applied a plurality of pushers 18 for the pack of negatives 7. Each pusher 18 consists of an L-shaped plate with its lower edge housed in a corresponding slot in the plate 9 and its body traversing the overlying slot in the base of the tray 10.

An electric motor 19 is keyed to the shaft 11 to drive the bar 16 between two end positions, namely a rear position in which the horizontal part of the pushers 18 is completely housed between the segments of the strip 13 (see FIG. 1), and a front position in which the ends of the pushers 18 emerge beyond the front edge of the interspace which houses them (see FIG. 2).

An arm 20 is keyed to the shaft 12 about which the tray structure 8 is hinged to the overall frame of the device, and to its end there is fixed a member 21 which is driven axially by an electric motor 22 by way of a screw system. A spring, not shown on the drawings for simplicity of representation, keeps the tray structure 8 balanced so that its movement about the axis of the shaft when driven by the motor 22 is smoother.

A shaft 23 is also rotatably supported by the overall frame of the device in a position overlying the guide 3 for the prints 4, and to it there are fixed two blades 24,25, which are of different length in the sense that their edge parallel to the shaft 23 is further from said shaft in the case of the upper blade 24 than in the case of the lower blade 25. The lower blade 25 extends from an arm 26, which is connected to a member 27 driven axially by an electric motor 20.

A plurality of automatic controls of known type provide correct operation of the device as is clear from the following description.

This operation will be clearer by describing it with reference to the moment in which one envelope-filling cycle has just been completed and the device is ready to effect the next cycle of a new order. At this moment the tray structure 8 is disposed horizontally and the two blades 24,25, rest by gravity with their front edge against the guide 1 for the envelopes 2. The envelopes 2 are of standard envelope type and are provided with two transverse pockets with the edge of the two openings parallel and such that the upper pocket for the negative 7 is less tall than the lower pocket for the prints 4. In this configuration the lower slotted plate 9 acts as an extension of the base of the guide 6 for the pack of negatives 7 and the longitudinal strip 13 acts as an extension of the lateral edge of said guide.

In the meantime a pack of negatives 7 to be inserted is formed in an upstream station; the pack of corresponding prints 4 to be inserted is formed in another upstream station; and the envelope 2 relative to that particular order is held ready in a envelope magazine not shown.

When the pack of negatives 7 has been formed it is driven by conventional systems along the guides 6 until it enters the interspace between the plate 9 and the base of the tray 10, where it is retained with its edge against the strip 13. During this stage, in which the pushers 18 are totally retracted with respect to the segments of the strip 13, any jamming of the negatives 7 is prevented notwithstanding the presence of the slots in the plate 9 and in the base of the tray 10, or of the strip 13, because of the sawtoothed shape of the various segments.

Simultaneously with the entry of the pack of negatives 7 into the interspace reserved for them, the envelope 2 for that order is fed along the guide 1 by a conveyor belt (not shown) until the edges of its two pockets have passed beyond the front edges of the two blades 24,25. This event is indicated by a photoelectric cell 29 positioined along the guide 1.

When the photoelectric cell senses the arrival of the envelope 2, after a short predetermined delay time which takes account of the dimensions of the wallet, it halts the envelope conveyor belt and reverses its direction of movement. The rearward travel of the envelope 2 causes its two pockets to be engaged by the two blades 24,25 and stops when this engagement has occurred. The distance of this return travel is also related to the dimensions and configuration of the envelope, and can be easily determined by a computer which has previously identified the type of envelope, for example by reading a bar code printed on it.

After the two pockets of the envelope have been engaged by the two blades 24,25 a command is fed to the electric motor 28 to cause its member 27 to act against the arm 25 and rotate the shaft 23, so raising the two blades 24,25 which open the two pockets of the envelope 2. A simultaneous command is fed to the electric motor 22 to cause its member 21 to act against the arm 20 and rotate the shaft 12 and the tray structure 8 downwards.

On termination of these movements the upper pocket of the envelope 2 is open facing the interspace formed by the plate 9 and the base of the tray 10, this interspaced being inclined downwards and already containing the pack of negatives 7 ready for insertion. The lower pocket of the envelope 2 is also open facing the guide 3 for the prints 4.

When this condition is attained a command is fed to the pusher 5 for the prints 4 to cause it to advance the pack of prints until it has entered the corresponding pocket of the envelope 2, and a command is fed to the electric motor 19 to drive the belts 15 and cause the pushers 18 to move along the respective slots, to withdraw the pack of negatives and feed it along its interspace as far as the corresponding open pocket of the envelope 2.

On termination of this insertion stage a further automatic command restarts the belts for conveying the envelope 2 towards the next handling station and at the same time initiates the return stroke of the print pusher 5 and operates the three electric motors 19,22,28. The motor 19 returns the pushers 18 to their waiting position between the segments of the strip 13. The motor 22 drives the relative member 21 in the opposite direction to the preceding stage, to return the tray structure 8 into its initial horizontal position ready to receive a new pack of negatives. The motor 20 drives the relative pusher 27, which withdraws from the arm 26 to enable the two blades 24,25 to again bear on the guide 1 in their rest position, to await the next envelope, the entire assembly then being ready to implement a new operating cycle.

From the description it is apparent that the envelope insertion device of the present invention offers a more advantageous performance than known devices which perform analogous functions, and in particular:

- it uses standard envelopes of any format, i.e., envelopes which always contain two opening pockets but having a format which is not constant but depends on the particular photographic shop (customer) using them,
- it is simpler construction and more reliable operation as it uses a single movement member which transfers the envelopes into the insertion station, causes its pockets to be simultaneously engaged by the members which open them, and finally transfer the filled envelopes to the next station,
- it automatically adapts to the different envelope formats by simply reading the bar code printed on every envelope. This is particularly important because it enables photographic laboratories to automate the different orders, while using for each order envelopes which are personalized for the corresponding client,
- it enables negatives and prints to be inserted simultaneously into the envelopes, so considerably reducing the overall average wallet time, it operates with exclusively mechanical members and therefore requires no air distribution system, it can be used for negatives and prints of practically any format, its various parts can be easily inspected and in particular the zone in which it handles the packs of negatives, this always being the most critical part of the device.

I claim:

1. A device for automatically inserting packs of photographic negatives and prints into an envelope having two pockets, comprising a longitudinal guide for a series of envelopes, a conveyor for moving each envelope along said envelope guide, a first pair of guides for receiving and supporting a pack of negatives to be inserted into said envelope, means for transferring each pack of negatives along said negatives guides, a second pair of guides for receiving and supporting a pack of prints to be inserted into said envelope, means for transferring single packs of prints along said second pair of guides towards said envelope, a pair of blades for independently engaging the edges of the two pockets of said envelope, each of said blades being movable between a lowered position, wherein said pockets adhere to said guide, and a raised position wherein the blades hold said pockets open for said pack of negatives and for a pack of prints, and a control system for halting the feed of said envelope along said guide after the edges of said two pockets have passed beyond said upper and lower blades respectively and for reversing movement of said envelope conveyor to effect said engagement, and for raising said blades in order to open said pockets.

2. A device as claimed in claim 1, wherein said negative transferring means comprises a pair of transversely slotted surfaces between which a pack of negatives may be introduced said surfaces each having a plurality of longitudinally extending slots, and a plurality of pushers mounted for movement along said slots, between a position retracted away from said blades, and an extended position nearer to said blade.

3. A device as claimed in claim 2, wherein the upper slotted surface comprises a tray and the lower slotted surface is a slotted plate disposed below the tray, said tray housing a bar extending transversely with respect to said negative guides and means for moving the bar along a path parallel to said slots, and wherein said pushers comprise L-shaped plates affixed to said bar, each pusher having vertical and horizontal legs, the vertical legs thereof passing through the slots of said tray and the horizontal legs thereof being received in the slots of said slotted plate.

4. A device as claimed in claim 3, further comprising a first hinge connection between said tray and said plate, and a second hinge connection between said negative guide assembly and said a stationary frame.

5. A device as claimed in claim 4, further comprising an arm affixed to said negative guide assembly, and actuator means driven by an electric motor for rotating said negative guide assembly about said second hinge axis.

6. A device as claimed in claim 1, further comprising a shaft, an arm mounted upon said shaft, and said two blades being rigidly affixed to said arm, and further comprising a pusher member driven by an electric motor, for pivoting said arm upon said shaft.

7. A device as claimed in claim 1, wherein said blades form the terminal portion of said guides, which direct said pack of negatives and said pack of prints towards the open pockets of said envelope.

* * * * *